US005927941A

United States Patent [19]

Kato et al.

[11] Patent Number: 5,927,941

[45] Date of Patent: Jul. 27, 1999

[54] HIGH-TEMPERATURE MOTOR PUMP

[75] Inventors: Hiroyuki Kato, Yokohama; Shuichiro Honda, Kawasaki, both of Japan

[73] Assignee: Ebara Corporation, Tokyo, Japan

[21] Appl. No.: 08/826,335

[22] Filed: Mar. 27, 1997

[30] Foreign Application Priority Data

Mar. 29, 1996 [JP] Japan ..... 8-103584

[51] Int. Cl.[6] ..... F04D 13/00; F01D 11/00; F03B 11/00

[52] U.S. Cl. ..... 415/112; 415/111; 415/143; 415/107; 417/423.1

[58] Field of Search ..... 415/111, 112, 415/143, 105, 107, 175, 176; 417/423.1, 423.12, 423.13, 424.2; 310/90.5

[56] References Cited

U.S. PATENT DOCUMENTS

| | | | |
|---|---|---|---|
| 1,966,855 | 7/1934 | Gregg | 415/111 X |
| 2,796,027 | 6/1957 | Brown | 415/112 |
| 2,799,227 | 7/1957 | Allen | 415/112 X |
| 2,921,533 | 1/1960 | Williams | 415/112 |
| 3,620,639 | 11/1971 | Gaffal et al. | 415/112 |
| 3,698,775 | 10/1972 | Gilbert | 308/10 |
| 3,788,762 | 1/1974 | Partos | 415/143 X |
| 3,918,852 | 11/1975 | Carter . | |
| 4,838,759 | 6/1989 | Dunn et al. | 415/143 |
| 5,553,742 | 9/1996 | Maruyama et al. | 417/410.3 X |

FOREIGN PATENT DOCUMENTS

| | | |
|---|---|---|
| 0 355 796 | 2/1990 | European Pat. Off. . |
| 2 649 165 | 1/1991 | France . |

OTHER PUBLICATIONS

"World Pumps" published by Elsevier Advance Technology, United Kingdon, Mar., 1991, p. 27, p. 29.

*Primary Examiner*—John E. Ryznic
*Attorney, Agent, or Firm*—Wenderoth, Lind & Ponack, LLP

[57] ABSTRACT

A high temperature pump is compact in size, reasonable in manufacturing cost and capable of stable pumping operation. The high-temperature motor pump includes a pump portion for pumping a liquid, a motor portion integrated with the pump portion for driving the same, and a rotatable shaft for transmitting rotation of the motor portion to the pump portion. A magnetic bearing is provided within the motor portion for supporting one end of the rotatable shaft by actively controlling a position thereof in a radial direction. A hydrostatic bearing is provided within the pump portion for supporting the other end of the rotational shaft in a radial direction by using a hydrostatic pressure of a portion of the liquid pumped by the pump portion.

3 Claims, 3 Drawing Sheets

HIGH-TEMPERATURE MOTOR PUMP

BACKGROUND OF THE INVENTION

1. Field of the Invention

The present invention relates to a high-temperature motor pump and a method of operation thereof, and more particularly to a high-temperature motor pump for pumping a high temperature liquid for use in a boiler system or a nuclear power plant.

2. Description of the Related Art

Conventionally, in order to pump a high temperature liquid, there has been used a motor pump in which a pump and a motor for driving the pump are connected by a common rotatable shaft. In such a conventional high-temperature motor pump, a usual contact-type bearing cannot be used for supporting the rotatable shaft since the bearing is not provided with proper lubrication due to the raised temperature of the bearing portion. In one trial to solve the above lubrication problem, non-contact type magnetic bearings are provided at both ends of the rotatable shaft, and a coolant is supplied into a gap of the bearing portion as needed.

However, in the above conventional high-temperature motor pump, since the space required for the magnetic bearing mechanism is large, the size of the entire motor pump and a space for installation thereof as well as production costs are increased. Particularly, because of a long passage for the coolant, the cost for circulating the coolant in the passage also becomes high.

SUMMARY OF THE INVENTION

It is therefore an object of the present invention to provide a high temperature pump which is compact in size, which has a less expensive manufacturing cost and which is capable of stable pumping operation.

In order to achieve the above object, there is provided a high-temperature motor pump comprising: a pump portion for pumping a liquid; a motor portion integrated with the pump portion for driving the same; a rotatable shaft for transmitting a rotation of the motor portion to the pump portion; a magnetic bearing provided within the motor portion for supporting one end of the rotatable shaft by actively controlling a position thereof in a radial direction; and a hydrostatic bearing provided within the pump portion for supporting the other end of the rotational shaft in a radial direction by using a hydrostatic pressure of a portion of the liquid pumped by the pump portion.

According to the present invention, the high temperature pump is compact in size, has a less expensive in manufacturing cost and is capable of stable pumping operation while maintaining a sufficient controllability for supporting the rotatable shaft.

In another aspect of the invention, the pump portion may comprise an impeller fixed to the rotatable shaft and a cylindrical body extending from the impeller, and the hydrostatic bearing is assembled at the cylindrical body. By such a construction, the hydrostatic bearing is assembled at the tip end portion of the rotational shaft so as to enable a stable support of the shaft, as well as to enable an easy formation of a fluid passage for introducing a high pressure liquid into the hydrostatic bearing from an outlet of the main impeller.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

Hereinafter, a preferred embodiment of the present invention will now be described in detail referring to the attached drawings.

Figure 1:
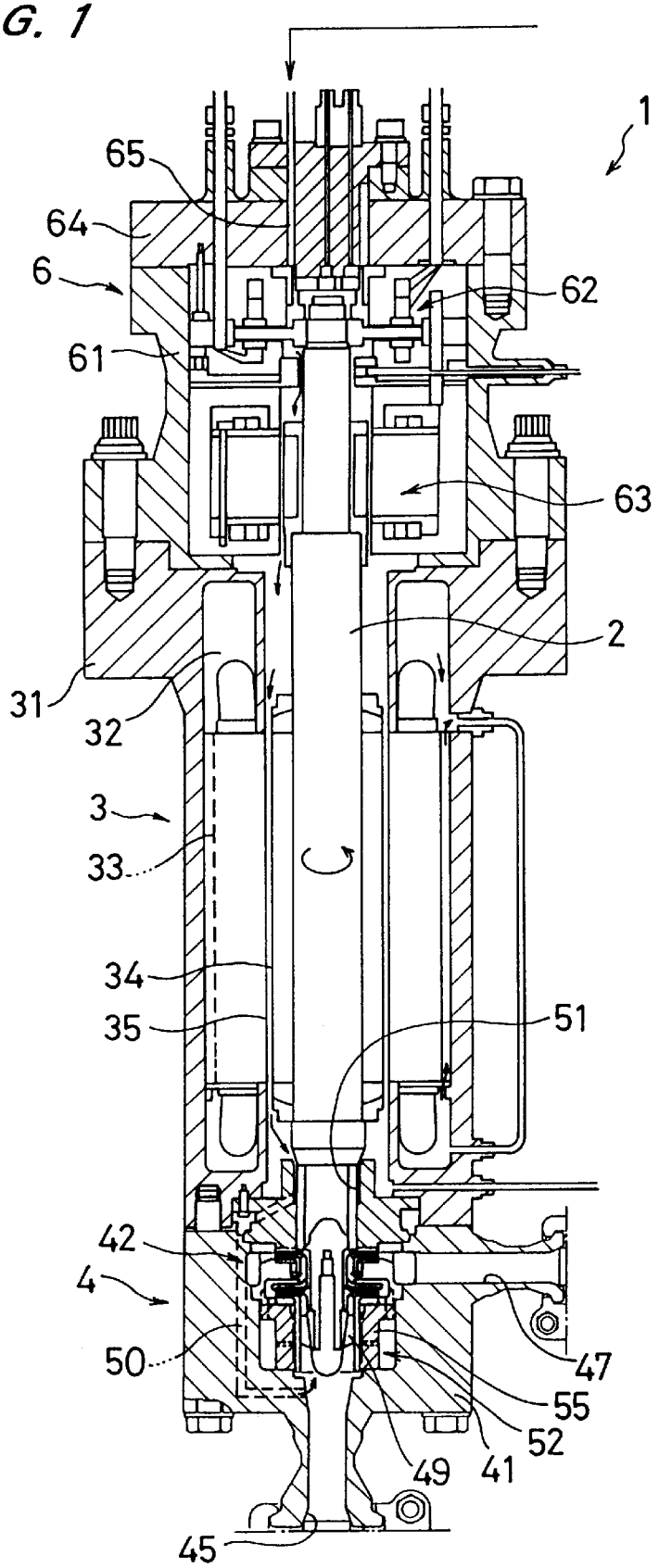
FIG. 1 is a vertical cross-sectional view showing a high-temperature motor pump of an embodiment of the present invention.
Figure 2:
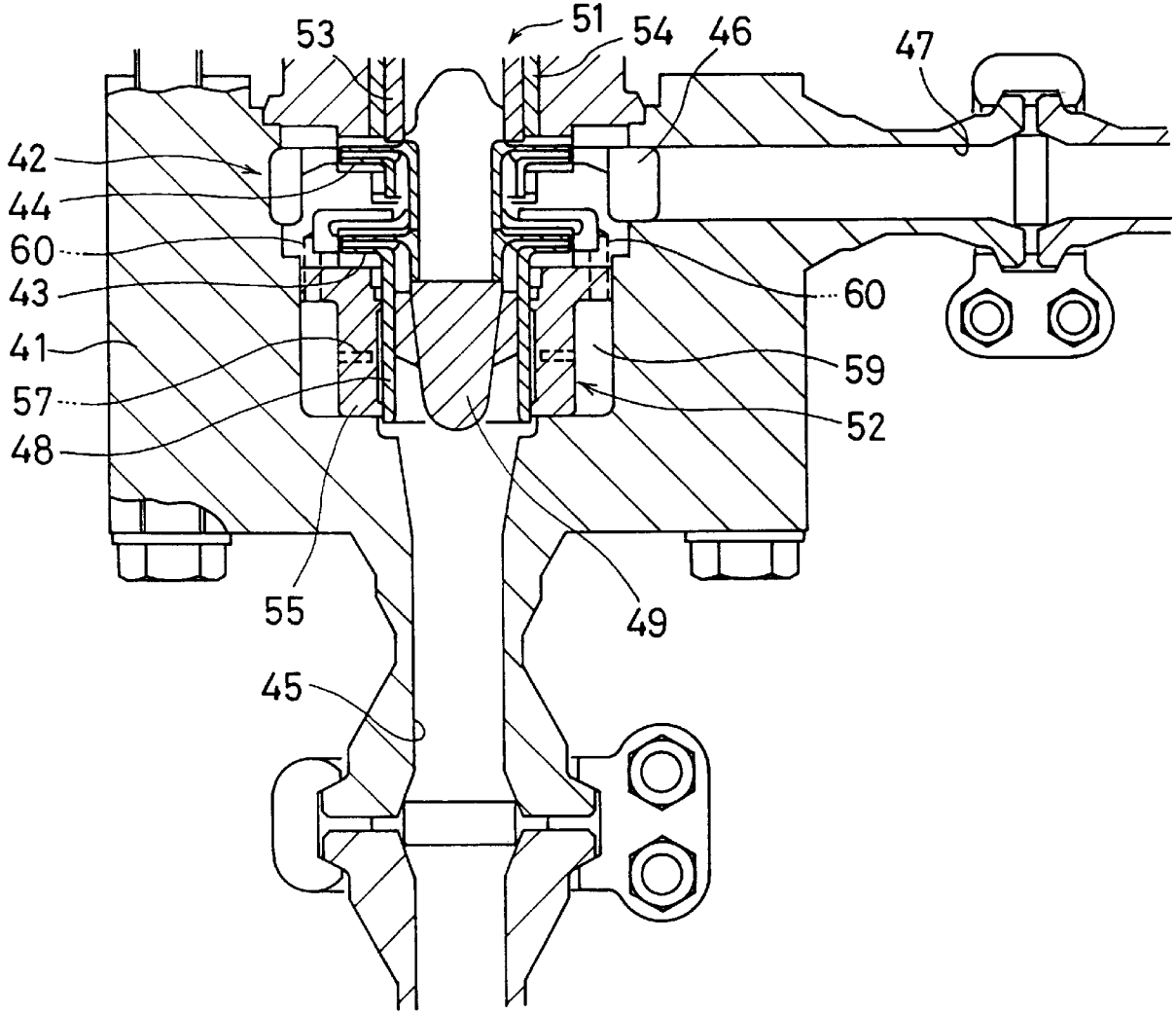
FIG. 2 is an enlarged view of FIG. 1 showing a pump portion.
Figure 3A:
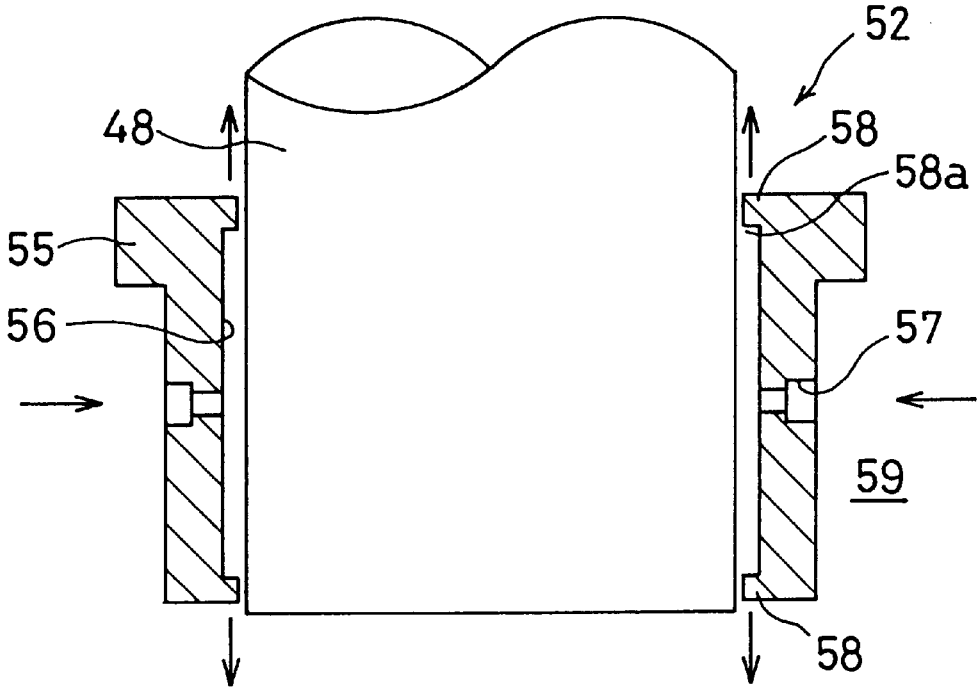
FIG. 3A is a vertical cross-sectional view showing a non-controllable bearing.
Figure 3B:
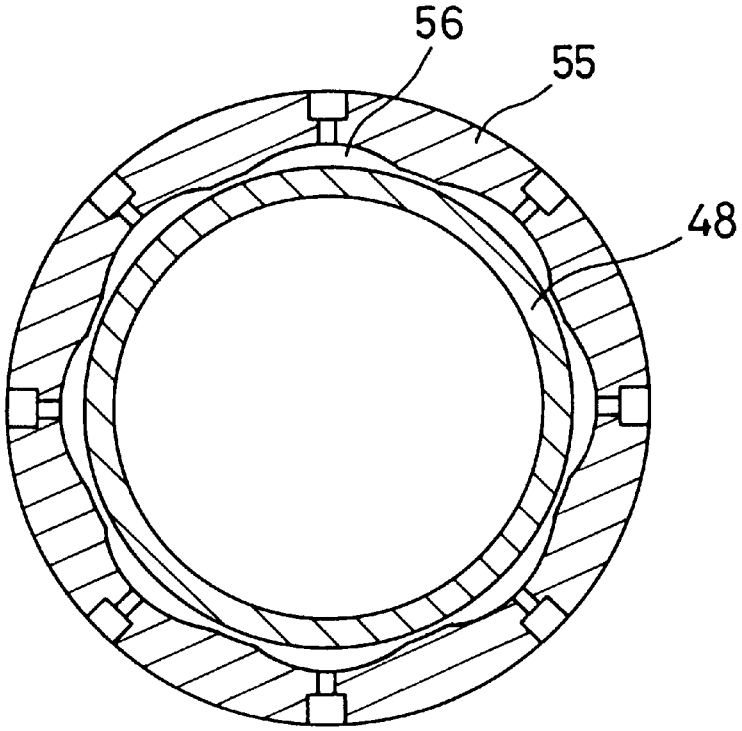
FIG. 3B is a horizontal cross-sectional view showing a non-controllable bearing.

As shown in FIGS. 1 through 3B, a high-temperature motor pump 1 of the present invention includes a pump portion 4 for pumping a high temperature liquid, a motor portion 3 for driving the pump portion 4, a common rotatable shaft 2 for transmitting the rotation of the motor portion 4 to the pump portion 3, and a magnetic bearing 6 for supporting the rotatable shaft 2 at a side of the motor portion 3.

The motor portion 3 comprises: a motor casing 31 having a cylindrical shape and connected to a lower end of a casing 61 of the magnetic bearing portion 6 through flanges; a stator 33 housed in a stator housing portion 32 having a cylindrical shape defined in the motor casing 31; and a rotor 34 provided within the stator 33 so as to rotate in conjunction with the rotatable shaft 2. Between the stator housing portion 32 and the rotor 34 is formed a ring-shaped gap portion 35.

The pump portion 4 includes a pump casing 41 connected to the motor casing 31 for defining a pump chamber 42 therein, in which two impellers 43, 44 fixed to the rotatable shaft 2 are provided. A suction inlet 45 for the liquid is provided at the bottom of the pump chamber 42, and a spirally-shaped outward-expanding scroll portion is formed in the circumferential portion to communicate with an outlet 47. A cylindrical mouth ring 48 is provided to extend from the inner edge of a front shroud of the first impeller 43 in the axial direction. Inside the mouth ring 48, an inducer 49 made of ceramics is fixed through shrinkage fitting at a location facing the suction inlet 45.

Inside the bearing casing 61, a thrust bearing 62 and a radial bearing 63 are provided. A cover plate 64 is provided to cover the upper opening of the bearing casing 61 in which a coolant inlet 65 is formed. Thus, a coolant passage is formed where a coolant flows from the coolant inlet 65 into the bearing casing 61, and then flows along the rotatable shaft 2 into the magnetic bearing portion 6 and the motor portion 3 for cooling and lubrication thereof, and after that, the coolant flows into the suction inlet 45 by way of an inner passage 50 formed in the pump casing 41.

The rotatable shaft 2 is supported by the upper magnetic bearing 6 which actively controls the shaft 2 in radial and axial directions, and is supported by two non-controllable bearings 51, 52 arranged at a lower end of the pump portion 4. The first non-controllable bearing 51 is formed as a sleeve bearing having a bearing sleeve 53 provided outside the rotatable shaft 2 and a bearing metal 54. A part of the coolant is supplied for cooling and lubricating the bearing sleeve 53 and the bearing metal 54.

The second non-controllable bearing 52 includes the above mentioned mouth ring 48 and a journal 55 having a cylindrical shape provided radially outside the mouth ring. On an inner surface of the journal 55, a plurality of depressions or grooves 56 extending in the axial direction are defined at circumferentially equal intervals, and a plurality of liquid inlets 57 communicating with each of the grooves 56 are also formed. At both axial ends of the journal 55, protrusions 58 protruding inwardly are provided so as to close the depressions 56 and to define narrow gaps 58*a* with the outer surface of the mouth ring 48. Outside the journal 55, a back pressure space 59 is formed for supplying a pressurized liquid by way of liquid inlet 57 to the gaps 58*a*, which communicates with a space outside the first impeller 43 through a passage 60.

The high-temperature motor pump described above works as follows. By operating the motor portion 3 to rotate the rotatable shaft 2, the liquid is pumped and flows from the suction inlet 45 to the outlet 47 by way of the inducer 49 and impellers 43, 44. At the same time, the coolant is introduced from the coolant inlet 65 to flow along the rotatable shaft 2 into the magnetic bearing portion 6, the motor portion 3 and the pump portion 4 for cooling and lubrication thereof.

The rotatable shaft 2 is actively controlled with regard to its position in the axial directions, and its position in the radial directions at its motor side end by the magnetic bearing 6. A portion of the pumped liquid flows out from the outlet of the main impeller 43 and into the back pressure space 59 through the passage 60, and then is introduced into the depressions 56 through the coolant inlet 57. Then, the liquid flows into the inlet 45 from the narrow gaps 58*a* while forming a lubrication film between the surfaces of the journal 55 and the mouth ring 48. By this flow of the pressurized liquid, the rotatable shaft 2 is also supported in its position in a radial direction at its pump portion side and is stably rotated by the hydrostatic bearing arrangement.

According to the high-temperature motor pump of the present invention, an expensive magnetic bearing is provided only at one end of the rotatable shaft. This can reduce the production cost of the entire pump while maintaining a sufficient controllability for supporting the rotatable shaft. Also, in the high-temperature motor pump, a magnetic bearing is replaced by the non-controllable type bearing which is much smaller than a magnetic bearing so as to present a compact and easy-to-use motor pump. Further, as the regions requiring cooling become smaller, the cooling load is reduced, which also serves to reduce the entire size of the pump.

Although a certain preferred embodiment of the present invention has been shown and described in detail, it should be understood that various changes and modifications may be made thereto without departing from the scope of the appended claims.

What is claimed is:

1. A high-temperature motor pump comprising:

a pump portion for pumping a liquid;

a motor portion integral with said pump portion for driving said pump portion;

a rotatable shaft for transmitting rotation of said motor portion to said pump portion;

a magnetic bearing provided within said motor portion for supporting one end of said rotatable shaft by actively controlling a position thereof in a radial direction;

said pump portion including an impeller fixed to said rotatable shaft and a cylindrical body extending from said impeller a hydrostatic bearing assembled at said cylindrical body within said pump portion for supporting an opposite end of said rotatable shaft in a radial direction by use of a hydrostatic pressure of a portion of the liquid pumped by said pump portion; and an inducer fixed within said cylindrical body.

2. A pump as claimed in claim 1, wherein said hydrostatic bearing is of a non-controllable type.

3. A pump as claimed in claim 1, wherein said inducer is formed of ceramic material.

* * * * *